United States Patent [19]

Baker et al.

[11] Patent Number: 5,050,305

[45] Date of Patent: Sep. 24, 1991

[54] HAIR TRIMMER WITH COMB ATTACHMENT

[75] Inventors: Richard I. Baker; Robert A. Mockovak, both of Newtown; Edward Szymansky, Fairfield, all of Conn.

[73] Assignee: Remington Products, Inc., Bridgeport, Conn.

[21] Appl. No.: 775,752

[22] Filed: Sep. 13, 1985

[51] Int. Cl.[5] ..... B26B 19/20; B26B 19/02

[52] U.S. Cl. ..... 30/201; 30/233.5

[58] Field of Search ..... 30/200, 201, 210, 216, 30/228, 233.5

[56] References Cited

U.S. PATENT DOCUMENTS 2,593,168 4/1952 Monyhan ..... 30/201
4,581,822 4/1986 Fujimura ..... 30/201
4,614,036 9/1986 Haraguchi ..... 30/200

FOREIGN PATENT DOCUMENTS 131854 9/1981 Japan .
116807 9/1982 Japan .

*Primary Examiner*—Douglas D. Watts

[57] ABSTRACT

A power driven hair trimmer appliance is fitted with a demountable comb attachment having a supporting segment of similar but larger configuration than the appliance. A plurality of discrete pressure pads are provided for fitting the comb to the appliance so that the comb may be adjusted to any position between predetermined maximum and minimum positions of trim length. At any operating position of the comb, trimmed hair will fall away from the appliance thereby eliminating the need to periodically interrupt trimming operations for cleaning the appliance.

3 Claims, 3 Drawing Sheets

Fig. 1.
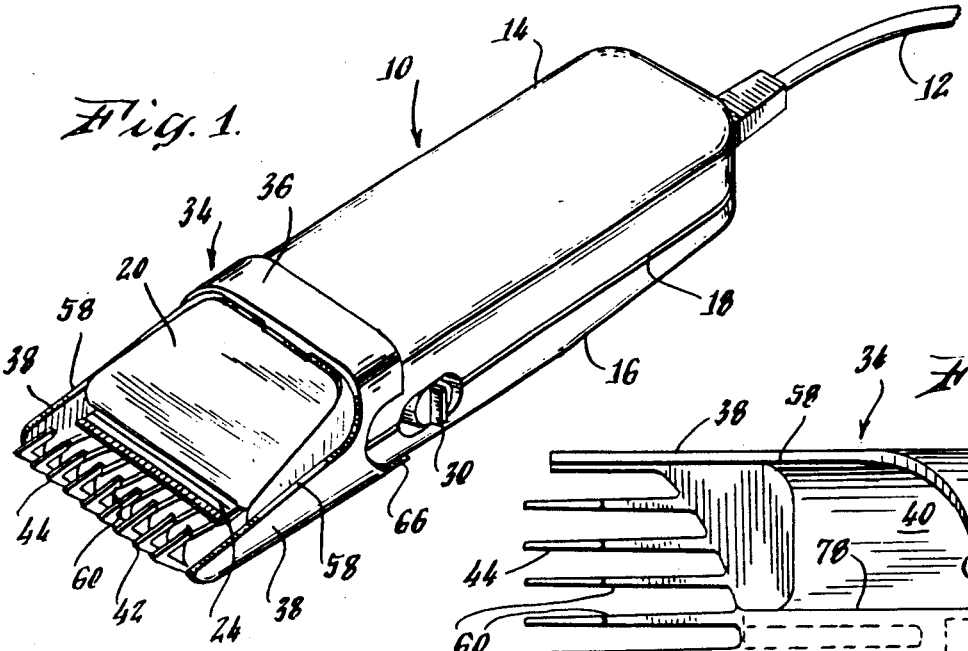
Fig. 2.
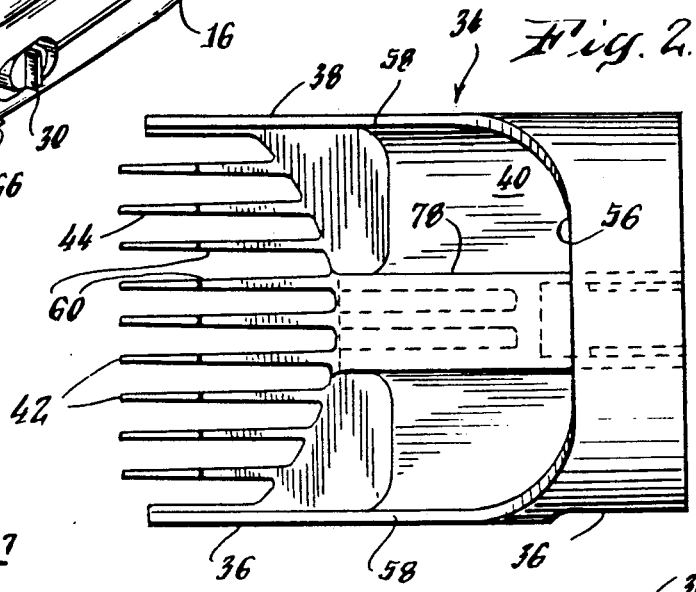
Fig. 3.
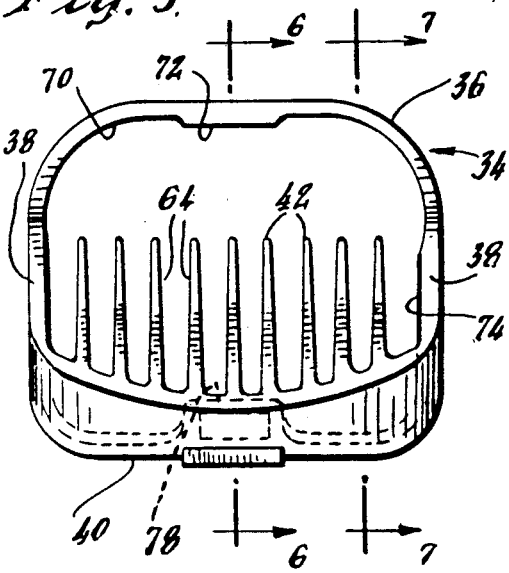
Fig. 4.
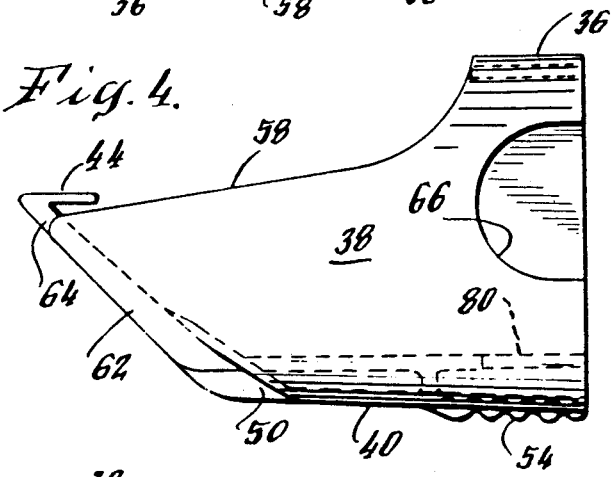
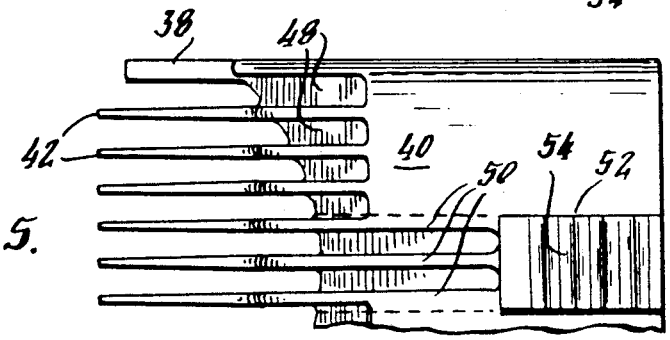
Fig. 5.

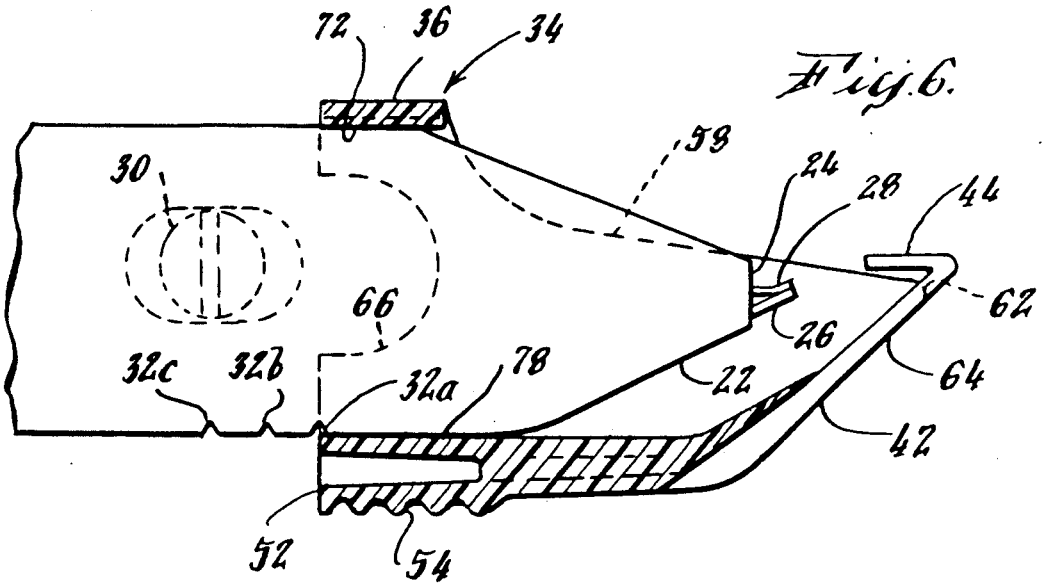
Fig. 6.
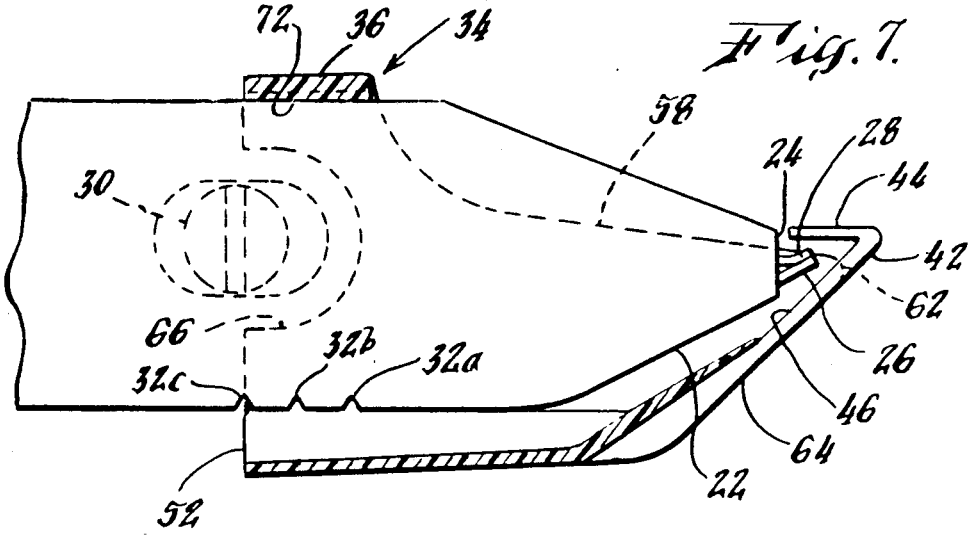
Fig. 7.
Fig. 8.
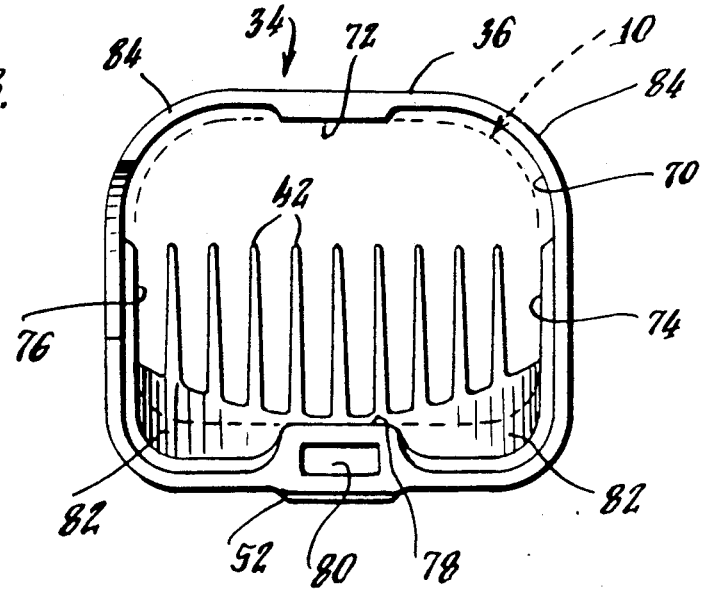

HAIR TRIMMER WITH COMB ATTACHMENT

BACKGROUND OF THE INVENTION

This invention relates to hair trimming appliances and more particularly to a comb attachment for mounting on a hair trimming appliance.

In a conventional hair trimming appliance with an adjustable trimming comb, there are provided several different positions of the comb attachment with respect to the trimming appliance to vary the closeness of the trim to an established hairdo. In a first position the outer tips of the comb attachment are at maximum distance from the cutter blades allowing for removing the least amount of hair trimming a hairdo to a relatively maximum length. In a second intermediate position, the comb attachment is drawn closer to the cutter blades by a given distance to trim hair to an intermediate length. In a third position, of minimum distance between the comb tips and the cutter blades, the maximum amount of hair may be removed and the hairdo is trimmed to the shortest length using this conventional hair trimming appliance adjustable comb combination.

In the first and second positions, the comb attachment is spaced relative to the body of the hair trimming appliance such that trimmed hair can freely fall away from the device. However, in the third position of the minimum length of trim, the rear edge of the comb attachment now comes into contact with the forward body of the trimming appliance thereby defining an open pocket between the comb attachment and the trimming appliance in which trimmed hair collects making it necessary periodically to interrupt the trimming operation in order to remove collected hair from the pocket. This is disadvantageous in that it interrupts the trimmer operator's concentration and trimming routine when such concentration and routine are necessary for a proper trimming operation.

In addition in such conventional trimming appliances, the limitation to essentially three fixed lengths of trimming distance inherently limits the usefulness of the trimming appliance.

Accordingly, it is an object of this invention to provide an improved hair trimmer appliance with comb attachment in which a greater variety of trimming lengths becomes possible.

Another object of the invention is to provide a hair trimmer comb attachment assembly in which it is no longer necessary to interrupt a trimming operation for the purpose of removing trimmed hair from between the comb attachment and the trimmer appliance.

Another object of the invention is to provide a comb attachment for a hair trimmer appliance in which the attachment fits over the cutting end of the hair trimmer appliance so that it is slideably adjustable with respect to the appliance to provide for selection of any trim length between maximum and minimum positions of the comb attachment.

Another object of the invention is to provide visual indicia between the comb attachment and appliance housing in order to correlate the position of the comb attachment with the familiar three fixed lengths of conventional trimmers for convenient reference by persons wishing to select one of the three positions.

SUMMARY OF THE INVENTION

In accordance with the features of the invention, an improved hair trimming appliance with a demountable comb attachment comprises an elongated hand-held trimming appliance housing with cutter teeth fixed at one end of the housing. A demountable comb attachment fits in slidable relationship over the cutting end of the trimmer appliance. The comb attachment has a supporting portion of similar but larger configuration than the outer contour of the trimming appliance. The interior surface of the comb attachment is provided with a pressure pad or pressure surface for engaging the outer surface of the trimmer appliance and for spacing at least one side of the comb attachment from the housing appliance in every operational position of the comb attachment with respect to the housing appliance. A second pressure pad is also provided and is integrally formed with the comb attachment or alternatively with the appliance housing. In one embodiment of the invention, the comb attachment includes a plurality of pressure pads and engages the upper and lower surfaces of the trimming appliance in frictional contact and under sufficient pressure so that the comb attachment may be adjusted to any position between maximum and minimum length locations such that the comb attachment remains in the selected position for trimming operations until readjusted by the operator to another position. In addition the inner surface of the comb attachment engages the side surfaces of the trimming appliance for proper lateral spacing of the comb attachment with respect to the appliance. In an alternative embodiment, pressure pads are formed on the housing and comb and are positioned for mutual engagement.

In an advantageous version of the invention, the surface of the trimmer appliance housing is provided with a plurality, particularly a set of three recess lines marking the conventional maximum, intermediate, and minimum trim lengths of conventional trimmers so that persons using a hair trimming appliance of the present invention can do so with assurance that the present invention will provide trim lengths of fixed position within the experience of the hair trimming operator.

DESCRIPTION OF THE DRAWING

These and other objects and features of the invention will become apparent with reference to the following specification and the drawing wherein:

FIG. 1 is a perspective view of the hair trimming appliance with demountable comb attachment according to the present invention.

FIG. 2 is a top plan view of the comb attachment according to the present invention.

FIG. 3 is a front elevational view on the comb attachment.

FIG. 4 is a side elevation view of the comb attachment.

FIG. 5 is a fragmentary, bottom plan view of the comb attachment.

FIG. 6 is a section view taken along line 6—6 of FIG. 3 and in addition shows the outline of a trimming appliance fitted to the comb attachment and located in a position for removing the least amount of hair and providing the maximum trim length.

FIG. 7 is a section view of the comb attachment taken along line 7—7 of FIG. 3 and in addition shows the outline of a trimming appliance fitted to the comb attachment in a position for removing the maximum amount of hair and providing the minimum cutting length.

FIG. 8 is a rear elevational view of the comb attachment according to the present invention showing in dot-dash lines the dot position of hair trimming appliance in assembly with the comb attachment.

DETAILED DESCRIPTION

Figure 9:
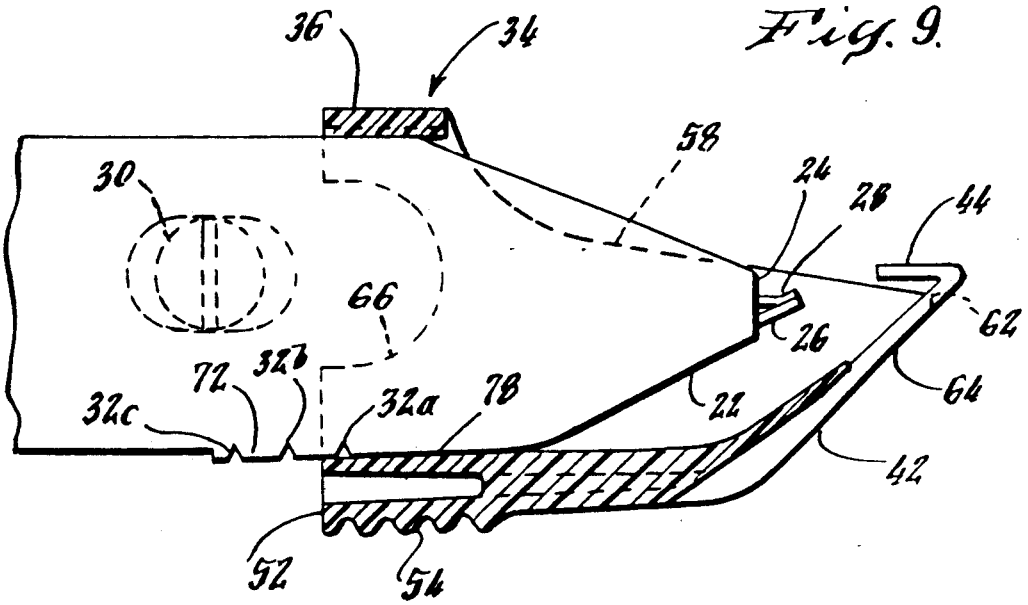
FIG. 9 is a section view similar to that of FIG. 6 of an alternative embodiment which illustrates the outline of a trimming appliance fitted to the comb attachment and located in a position for removing the least amount of hair and providing the maximum trim length.

Referring now to the drawings and to FIG. 1, the hair trimmer appliance with removable comb attachment according to the present invention includes preferably an electrically powered hair trimming Appliance 10 fitted with a power cord 12. If desired, the trimming appliance may be made portable and equipped with batteries fitted within the appliance. The hair trimmer appliance includes front 14 and rear 16 housing segments joined along a longitudinally extending dividing line 18. The front and rear housing segments slope at 20 (FIG. 1) and at 22 (FIG. 6) toward the cutting end of the hair trimmer appliance and terminate at the cutting end 24. The cutting means includes stationary 26 and moveable 28 blades fitted with teeth which define the cutting edges of the appliance in a well-known manner. The appliance is provided with a slide switch 30 for actuating the moveable cutter blade when desired to operate the appliance. The assembled appliance 10 is of pre-determined outer contour of suitable configuration and typically the contour may be oval as indicated in broken lines in FIG. 8.

As shown in FIGS. 6 and 7, the appliance housing is provided with a plurality, preferably a set of three visual indicia such as recess marks 32*a, b,* and *c* for indicating to the operator the maximum, intermediate, and minimum cutting lengths with which the operator may be familiar through use of a conventional trimming appliance available from the assignee of this invention. The foremost set of recess marks 32*a* indicate the conventional position of maximum trim length. The middle set of marks 32*b* indicate the intermediate conventional position and the rearmost 32*c* indicate the minimum conventional trim length.

Referring now to FIGS. 2–5, a removeable comb attachment 34 is preferably of integral construction and fabricated of lightweight materials such as plastic by well-known techniques such as injection molding.

The comb attachment includes a band-shaped supporting segment 36 of similar configuration to the trimmer appliance housing and being somewhat larger in outer dimension than the appliance housing. Sidewalls 38 and a bottom wall 40 project forwardly from the supporting band. A plurality of comb teeth 42 project forwardly and upwardly from the bottom wall of the comb attachment at a given angle to a point beyond the center line or the plane of the cutting blades. Preferably the comb teeth terminate in reversely directed tips 44 which protrude beyond the plane of the cutting blades 26, 28. There is a sufficient number of comb teeth to extend the full width of the cutting blades. The teeth are spaced from each other to provide free and full access of the cutting blades to the hairdo being trimmed regardless of the length selected for a particular trimming operation. As shown in FIG. 7, the tips 44 of the comb teeth are positioned closely adjacent the forward end of the trimming appliance and provide for suitable spacing of the interior surface 46 of the comb teeth such that the cutting blades do not cut into the comb teeth. Comb teeth are spaced by wall segments 48 (FIG. 5) of generally concave configuration occurring in the bottom wall of the comb attachment. For added rigidity and for attractive appearance, several of the teeth 42 continue beyond the others in the form of upstanding ribs 50 for reenforcing the bottom wall of the trimmer. The upstanding ribs terminate in a thumb-actuated push tab 52 protruding below the bottom wall and having an undulating surface 54 for purposes of manual adjustment of the comb attachment with respect to the trimming appliance. As best shown in FIGS. 1 and 2, the comb attachment is substantially open in the area defined by the front edge 56 of the support band, the upper edges 58 of the side walls and the extremities 60 of comb tips in order to provide for full and free access to the cutting blades to the hairdo being trimmed.

It is to be noted (FIGS. 4, 6 & 7) that the upper edges of side walls 38 slope generally forwardly toward the comb teeth and their extreme forward ends 62 are generally aligned with the angled leading edges 64 of the comb teeth to provide lateral protection for the comb teeth. Additionally, the upper edges 58 extend above the center line of the cutting blades to prevent unwanted side access to the cutting blades. Finally, the rear edge of the supporting band is recessed at 66 to accommodate the slide switch 30.

The interior surface 70 (FIGS. 3 & 8) of the comb attachment is provided with a plurality of contact surfaces 72, 74, 76, 78 for engaging the surface of the trimmer appliance and for securably retaining the comb attachment in telescoping relationship to the trimmer appliance. The supporting band at its interior surface 70 is provided with a pressure pad 72 integrally molded or otherwise fitted to the attachment. The pressure pad is slightly raised from the inner wall of the comb attachment and preferably tapers in thickness in the direction of its length, the smaller thickness being forward of the pad. The supporting board and the bottom wall 40 are, substantially for their full length, provided with a contact surface 78 lying substantially in confronting relationship with the top wall contact surface 72 to the extent they overlap as shown in FIGS. 6, 7 and 8. The rear portion of the supporting band in the vicinity of the thumb tab 52 and the pressure pad 78 is recessed at 80 to allow for slight flexing of a resilient segment 81 of the pressure pad 78 such that it provides an interference fit between comb and appliance promoting desirable frictional engagement between the two as an aid in retaining the comb attachment on the appliance.

As best shown in FIGS. 3 and 8, the interior surface of the supporting band adjacent the side walls is also provided with contact surfaces 74 and 76 which are raised with respect to the general interior surface 70. These surfaces provide for proper lateral positioning of the comb attachment with respect to the appliance. It is desired to have an interference fit between these lateral surfaces and the outer surface of the appliance housing as in the case and for the same reason pertaining to the upper and lower surfaces 72, 78.

FIGS. 6–8 show particularly the assembly of comb attachment and trimmer appliance. In FIG. 6 the comb attachment 34 is shown at the maximum conventional trim length position indicated by the forwardmost recessed lines 32*a*. If desired, the trimmer-operator may position the comb attachment slightly more to the front of the appliance beyond the forward recessed lines. FIG. 7 shows the rearmost position of the comb attachment with respect to the trimmer appliance. As noted above, the rearwardly directed tips 44 of the comb teeth provide abutting engagement with the front end 24 of the appliance housing not only to guard the cutting edges but also to define the practical limit of rearward travel of the comb with respect to the appliance. By manipulating the thumb tab 52 any position between maximum and minimum trim positions can be selected it being understood that the frictional engagement between contact surfaces and appliance housing is sufficient to retain the comb attachment in fixed position during trimming operations.

As best shown in FIGS. 7 and 8 in which the comb attachment is in the position of minimum cutting length, the spaces 82 between the comb attachment and appliance bottom provide for free passage of trimmed hair away from the appliance to the cutting room floor. In addition, the spaces 84 between comb attachment and appliance top also provide for free passage and removal of trimmed hair during trimming operations. In this manner, the trimming operator may at all times concentrate on the work at hand without having to be interrupted periodically for purposes of cleaning the trimmer. This is particularly the case in the position of minimum trim length shown in FIG. 7.

Figure 10:
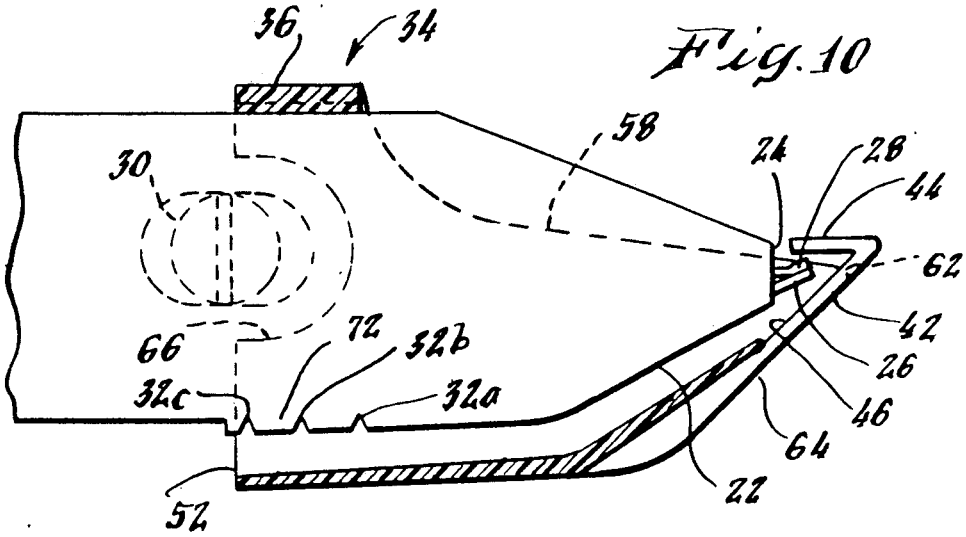
FIG. 10 is a section view similar to that of FIG. 7 of an the embodiment of FIG. 9 which illustrates the outline of a trimming appliance fitted to the comb attachment in a position for removing the maximum amount of hair and providing the minimum cutting length.
Figure 11:
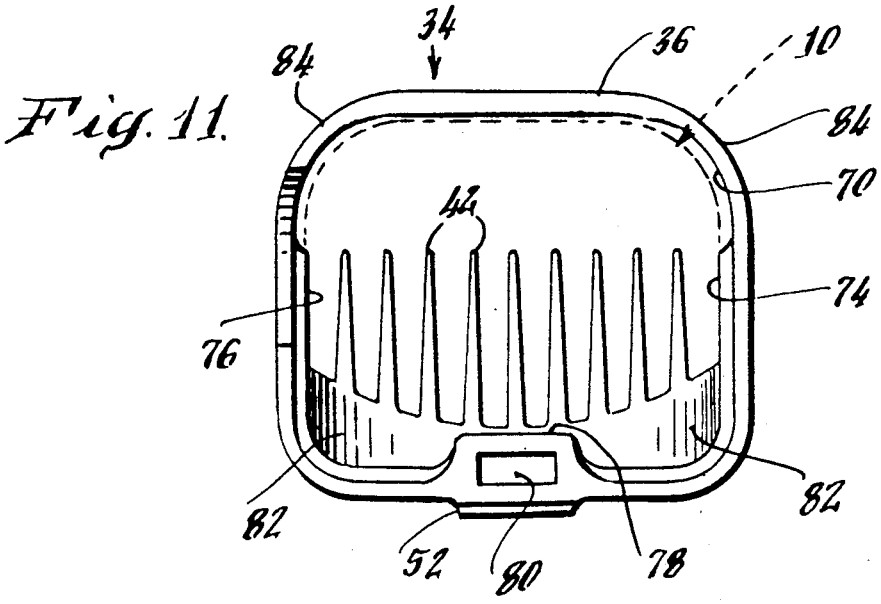
FIG. 11 is a rear elevational view of the comb attachment used with the embodiment of FIG. 9 showing in dot-dash lines the dot position of hair trimming appliance in assembly with the comb attachment.

FIGS. 9–11 illustrate an alternative embodiment wherein the pressure pad 72 is integrally formed with the housing and engages the pressure pad 78. Since the pressure pad 72 is formed integrally with the housing, the comb has formed thereon only the pressure pad 78. Recess marks 32*a*, 32*b* and 32*c* are formed in the pad 72.

While there have been described particular embodiments of the invention, it is to be appreciated by those skilled in the art that variations may be made thereto without departing from the spirit of the invention and the scope of the appended claims.

What is claimed is:

1. An improved electrically energized, hair trimmer, comprising:

a. an electrically energized hair trimmer having an outer housing of predetermined cross-sectional configuration adjacent one end thereof, a power source, and a hair trimming means projecting from said one end of the housing in a predetermined plane;

b. a comb member demountably positioned on the trimmer adjacent the one end thereof in operative relationship to the trimming means;

c. said comb having a band-like support member with a cross sectional configuration conforming with and larger than the trimmer housing configuration;

d. said support member having an inner upper surface thereof;

e. said comb having a bottom wall and side walls extending forwardly from the support member toward the trimming means;

f. said bottom wall having a surface thereof;

g. said comb having a substantially open top end thereto;

h. a plurality of comb teeth extending from the front edge of the bottom wall across the front end of the hair trimmer, said teeth having tips in confronting and operative relationship with the trimming means;

i. a plurality of contact surfaces projecting inwardly from the interior surface of the support member of the comb for adjusting the comb between predetermined positions of maximum and minimum trim length and for defining interior passages between the trimmer housing and the interior comb surface for all operative positions of comb and housing;

j. said inner upper surface of said support member and substantially the entire length of said inner surface of said bottom wall of the comb fitted with contact surfaces for frictional engagement with the trimmer housing and for defining interior passages between said comb and trimmer for the free passage of hair being trimmed.

2. An improved power driven hair trimmer defined in claim 1 in which the side walls of the comb are fitted with interiorly projecting contact pads to laterally position and comb to said trimmer housing.

3. An improved power driven hair trimmer as defined in claim 2 in which there is an interference fit between contact pads and trimmer housing.

* * * * *